United States Patent [19]

Lycan

[11] Patent Number: 4,563,549

[45] Date of Patent: Jan. 7, 1986

[54] REVERSING SWITCH

[75] Inventor: Jennings Lycan, Huntington, W. Va.

[73] Assignee: Service Machine Company, Huntington, W. Va.

[21] Appl. No.: 662,493

[22] Filed: Oct. 18, 1984

[51] Int. Cl.[4] ..... H01H 9/00

[52] U.S. Cl. ..... 200/1 V; 200/16 E; 200/163

[58] Field of Search ..... 200/1 R, 1 V, 5 R, 11 EA, 200/11 TC, 14, 16 B, 16 E, 17 R, 18, 153 R, 153 T, 161, 163

[56] References Cited

U.S. PATENT DOCUMENTS

| | | | |
|---|---|---|---|
| 1,752,213 | 3/1930 | Treanor | 200/16 E |
| 3,222,485 | 12/1965 | Hardesty et al. | 200/163 X |
| 3,315,057 | 4/1967 | Geltner | 200/153 R |
| 3,639,704 | 2/1972 | Alinder | 200/163 X |

*Primary Examiner*—J. R. Scott

*Attorney, Agent, or Firm*—McCaleb, Lucas & Brugman

[57] ABSTRACT

A reversing switch comprises a mounting plate assembly with a hub adapted to extend forwardly through a wall of an explosion proof enclosure. A shaft is journaled for both rotational and axial movement in the hub. A stationary contact assembly consists of a first set of four evenly circumferentially spaced contacts, each with a connecting terminal, mounted on an insulator base. A movable contact assembly consists of a second set of four evenly circumferentially spaced contacts mounted on an electrical insulating member connected to the shaft. Adjacent pairs of the movable contacts are interconnected. The shaft has an external handle with a unique cam and rotatable eccentric pivot connection for moving the shaft axially to engage or disengage the contacts when the handle is pivoted forward and backward a half turn, and for rotating the shaft to reverse the contacts when the handle is rotated a quarter turn. One or more control switches between the contact assemblies are actuated by relative movement between the contact assemblies for a variety of control and monitoring functions. A spring normally urges the contacts apart.

6 Claims, 16 Drawing Figures

Fig. 5

Fig. 4
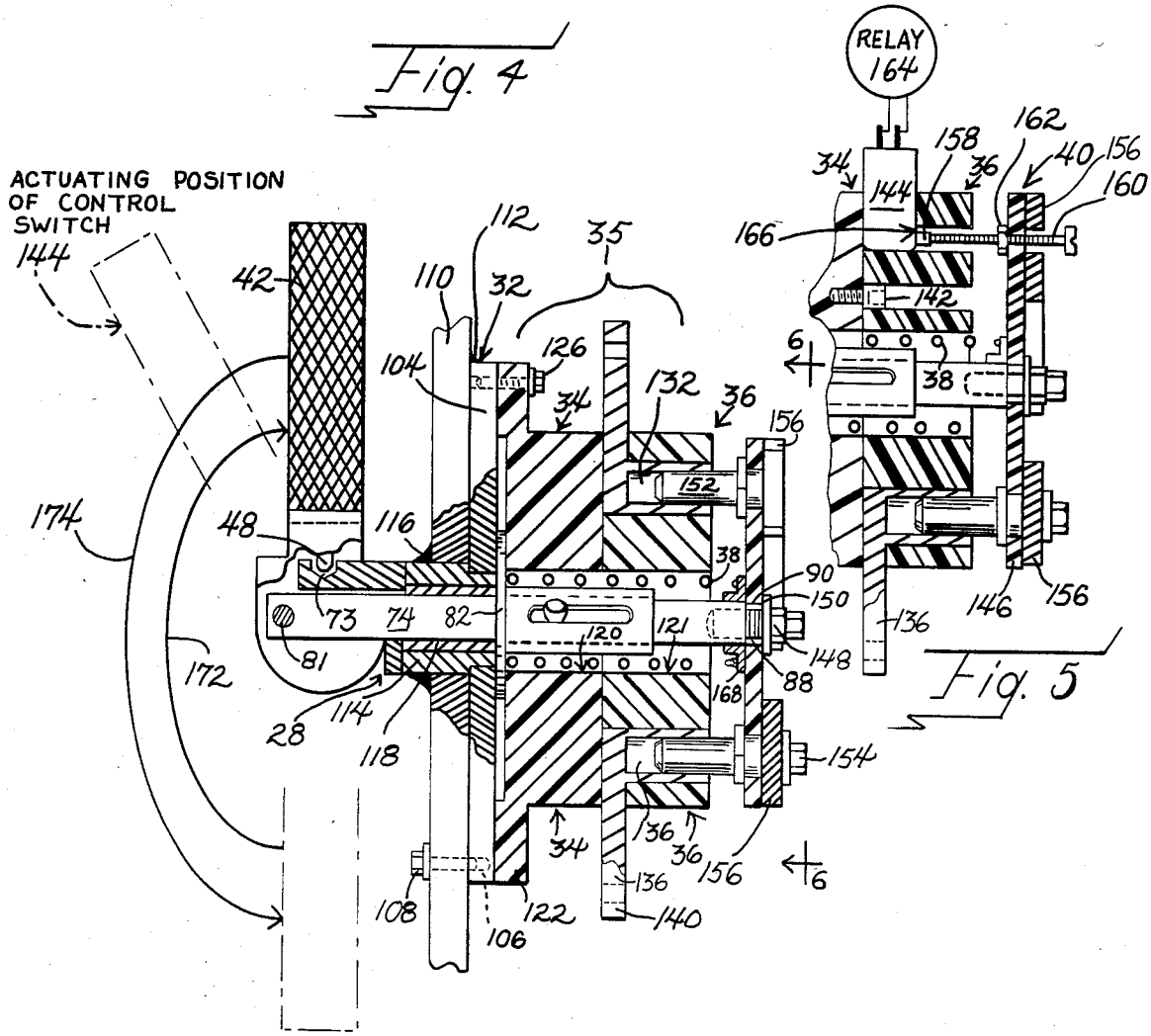
Fig. 5
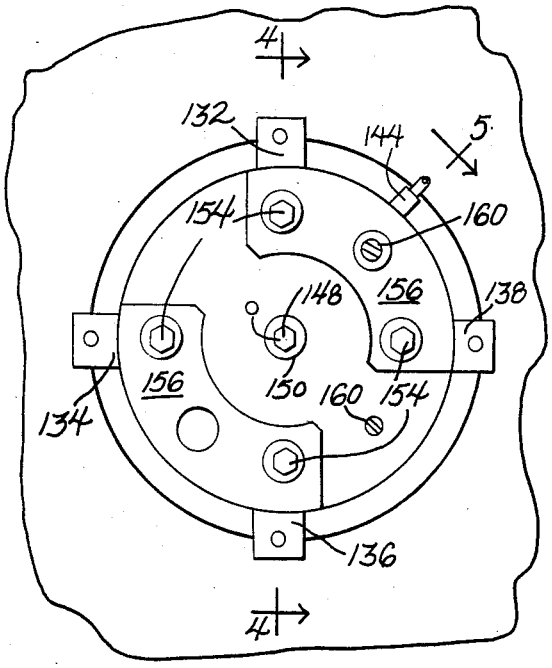
Fig. 6

FORWARD
42
130
84
82
134
68
68
170
42

REVERSE
132
130
138
42
84
42
82
170
136

132
134
156
138
146
136

132
134
156
146
138
136

LOCKED
42
50
64
46
66
62
48
60
44
26
72
70
68

RELEASED
54
50
52
64
62
56
58
48
60
44
72
26
68
70

Fig. 13
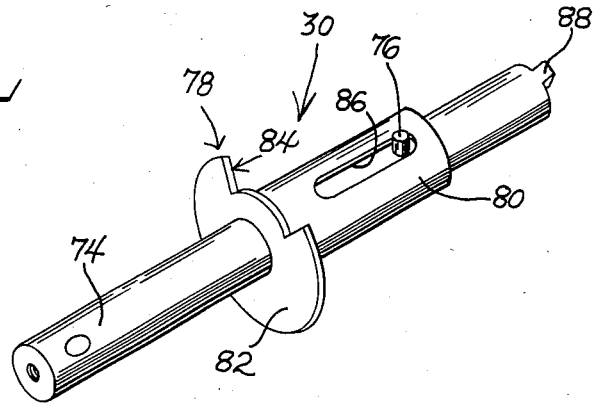
Fig. 14
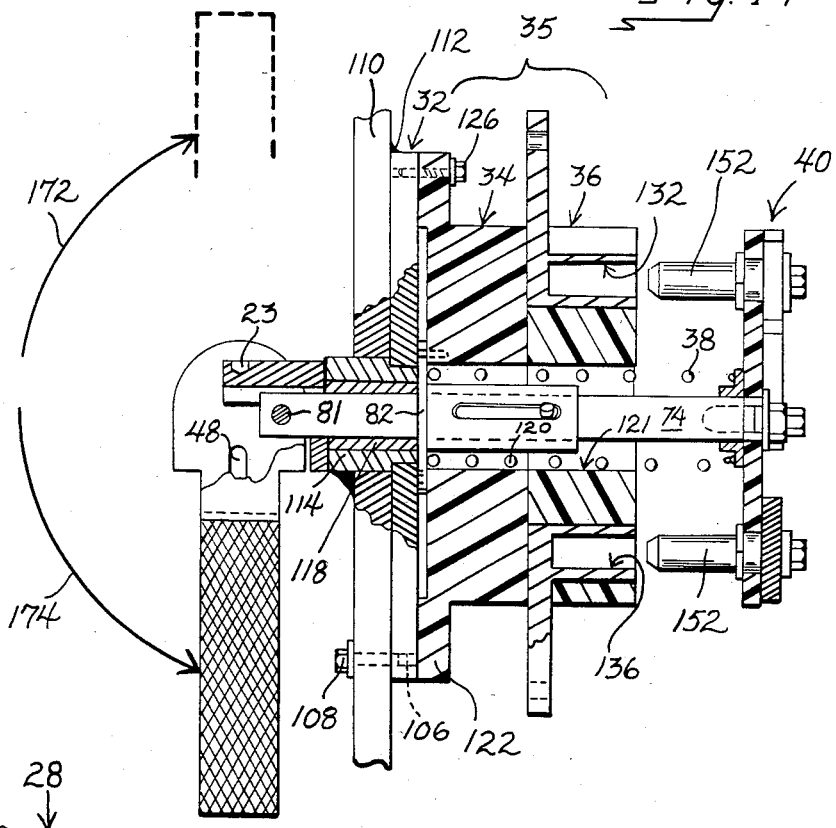
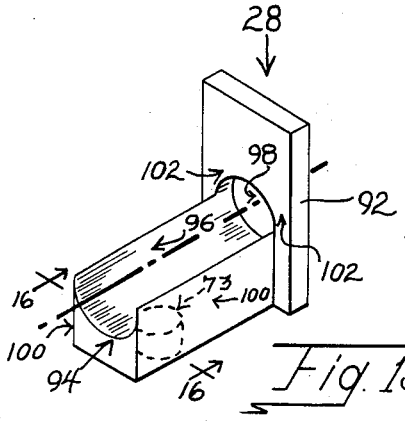
Fig. 15
Fig. 16
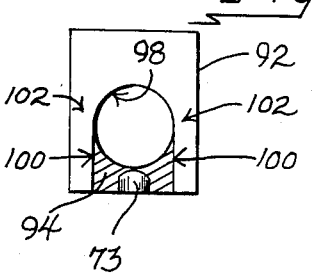

REVERSING SWITCH

BACKGROUND OF THE INVENTION

The invention belongs to the field of electrical switches and particularly to a reversing switch for large three phase induction motors.

Bulk materials handling conveyors, such as those used in underground coal mines, are examples of electrically driven equipment which commonly requires reversing facilities. Electrical power equipment used near the working face in coal mines must be "explosion proof" to prevent electrical sparks or arcs from igniting any explosive mixture of methane and air which may be present. Hence any electrical reversing switch intended for use on coal face equipment must be in an explosion proof enclosure. Reversing switch mechanisms previously available have not been easily or inexpensively adaptable for use within explosion proof enclosures.

In certain applications, such as the electric drive and controls for a coal plow operating along the face in a longwall mining system, the motor drive is operated forward and then reverse in a cyclic manner. The motor control equipment includes separate forward and reverse contactors which are operated alternately. That arrangement while effective for such special purposes is objectionably bulky and expensive for many other motor reversing applications such as conveyors which run in one direction to move coal out of the mine but is reversed from time to time to move supplies and personnel into the mine.

Prior to the present invention, no fully suitable reversing switch has been available.

SUMMARY OF THE INVENTION

Accordingly, it is a general object of the present invention to provide a high capacity reversing switch for a three-phase power source which is simple, compact and easily fitted for use in an explosion proof enclosure.

Another object is to provide a reversing switch usable in an explosion proof enclosure in which the only opening to the potentially explosive ambient mine atmosphere is through an operating-shaft-guiding hub which may be made of suitable length to safely quench any flame or burning gases exiting through the hub.

Another object is to provide a reversing switch with an external dual motion handle which is pivotable forward and backward to move internal contact assemblies between engaged and disengaged positions, and is also swingable or rotatable sidewise to move the contact assemblies between foward and reverse conductive modes.

Another object is to provide an electrical reversing switch in which an external handle operates internal contact assemblies via a shaft which is selectively movable in both rotary and axial directions, the shaft is movable in the rotary direction by a direct connection to the handle, and the shaft is movable in the axial direction by a unique cam and eccentric pivot connection to the handle which provides an increasing mechanical advantage between the handle and the moving contact assemblies as the latter approach their fully seated positions relative to the stationary contact assemblies.

Another object of the present invention is to provide such a reversing switch with improved interlock mechanism within the enclosure for automatically actuating remote main power supply contactors in response to relative movement of the switch contacts to thereby open the power supply contactors prior to disengaging the reversing switch contacts, and to close the power supply contactors only after engaging the reversing switch contacts.

BRIEF DESCRIPTION OF THE DRAWINGS

FIG. 4 is a longitudinal cross-section view of the reversing switch showing it assembled and in forward engaged mode, this view being taken along line 4—4 of FIG. 6;

FIG. 5 is a fragmentary longitudinal cross-section view of the reversing switch, this view being taken along line 4-0-5 of FIG. 6;

FIG. 6 is a rear view of the assembly shown in FIGS. 4 and 5, taken in the direction of line 6—6 in FIG. 4;

FIG. 13 is a perspective view of the rotary shaft assembly;

FIG. 14 is a view similar to FIG. 4 showing the switch disengaged;

FIG. 15 is an enlarged view of the operator base member 28 shown in FIG. 3; and FIG. 16 is a transverse sectional view of FIG. 15 taken along line 16—16.

DESCRIPTION OF THE PREFERRED EMBODIMENT

Referring now more specifically to the drawings, the direction of rotation of a three phase induction motor can be reversed by interchanging any two of the three connections between the power supply and the motor.

Figures 1, 2, 3:
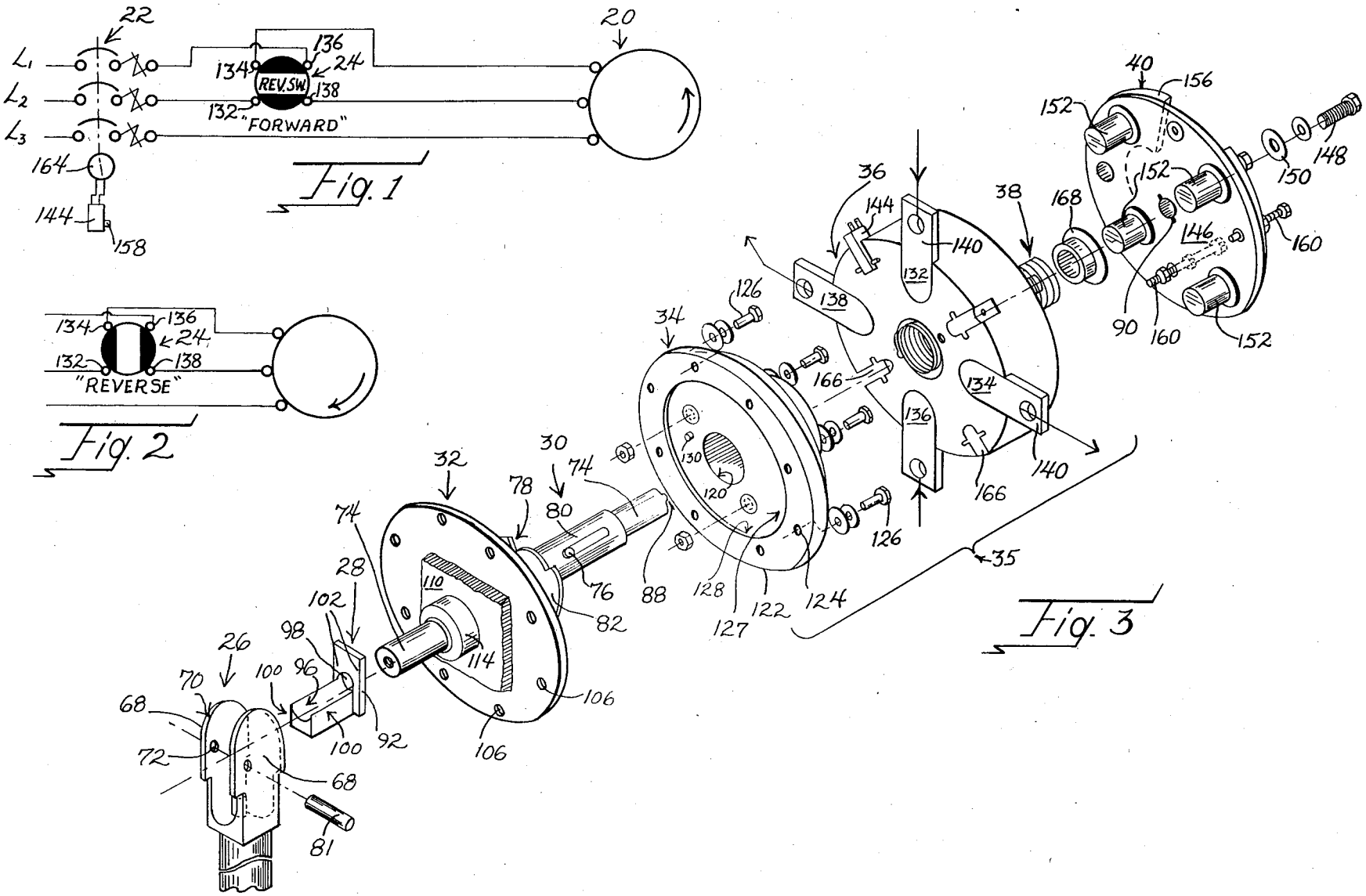
FIG. 1 is a diagrammatic representation of a circuit showing a reversing switch positioned to reverse two of three lines of a three-phase electrical power supply to a three-phase motor.
FIG. 2 is a portion of the FIG. 1 circuit showing the switch reversed with respect to FIG. 1.
FIG. 3 is an exploded perspective view of a reversing switch illustrating one form of the present invention.

FIG. 1 is a diagramatic representation of a circuit having a three phase induction motor 20 energized through three phase power leads L1, L2 and L3 and controlled by main contactors 22 which may be remote from the motor. A reversing switch schematically representing the present invention is indicated by the numeral 24 in FIGS. 1 and 2.

Referring now to the specific embodiment of the invention in the drawings, the reversing switch 24 comprises the following major components as seen from left to right in FIGS. 3 and 4:

an operating handle sub-assembly 26;
an operator base member 28;
a rotary shaft sub-assembly 30;
a mounting plate assembly 32;
a stationary contact assembly 35;

a compression spring 38; and a moveable contact assembly 40.

Figure 11:
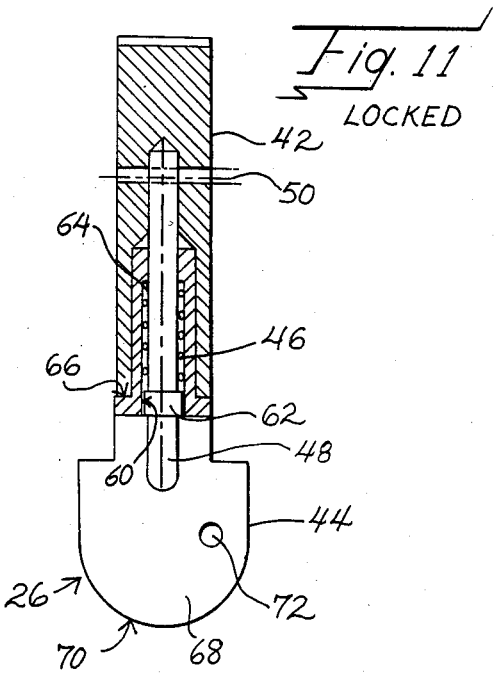
FIG. 11 is a longitudinal sectional view of the handle assembly taken along line 11—11 in FIG. 7.
Figure 12:
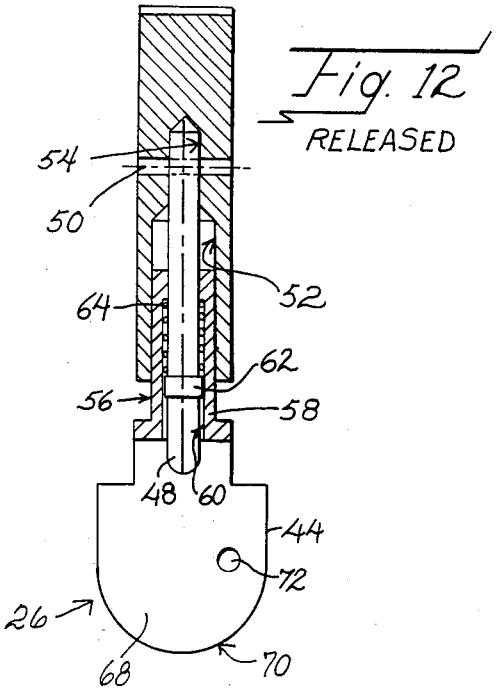
FIG. 12 is a view similar to FIG. 11 showing the handle assembly extended and unlocked.

Referring to FIGS. 11 and 12, the operating handle sub-assembly 26 comprises a handle 42, a split cam member 44, a compression spring 46, a detent or plunger 48, and a roll pin 50. The handle 42 is slidably mounted on cam member 44 by means of a longitudinally slidable connection between the bore 52 and a cylindric surface 56 on a cam member extension 58. The latter has an axial bore 60 slidably engaging a cylindric enlargement 62 on the plunger. The spring 46 is located in bore 60 and is compressibly interposed between the enlargement 62 and shoulder 64, thereby urging the handle 42 toward an inward, locked position abutting shoulder 66 as shown in FIG. 11.

The split cam member 44 has a pair of transversely spaced cam arms 68,68 (see FIG. 7) with arcuate cam faces 70,70 on the forward end edges. Eccentrically located openings 72 provide eccentric mountings for a cam member pivot pin connection to provide an increasing mechanical advantage as needed when the moveable contacts approach their fully seated positions as will be explained below.

The operator base member 28 is an important part of the present invention and is shown enlarged in FIGS. 15 and 16. It comprises a vertical plate portion 92 with an integral forwardly extending tongue portion 94. The latter has an upper, cylindrical, concave surface 96 aligned with opening 98 in plate portion 92 to receive the forward end portion of a shaft 74. The central tongue portion 94 is of sufficient width that the flat side surfaces 100 fit snugly between cam arms 68 so the operator base member 28 will rotate with the handle sub-assembly 26. The sides of plate portion 92 which extend beyond surfaces 100 provide cam engaging surfaces or tracks 102 for the arcuate cam faces 70,70.

As best shown in FIGS. 4, 15 and 16 a transverse recess 73 is provided in the forward end of the tongue portion 94. It engages the detent plunger 48 to hold the switch contacts in fully seated position as shown in FIG. 4.

As best shown in FIG. 13, the rotary shaft subassembly 30 includes the central shaft 74 with a radial pin 76, and a rotary stop member 78, the latter consisting of a sleeve 80 slidably mounted on the shaft with a transverse circular plate or flange 82 having a quadrantal cut-out 84 limiting rotation of the assembly to a quarter turn. The shaft 74 is limitedly longitudinally slidable within the rotary stop member 78, but the two are concurrently rotatably in either direction because of the engagement of the radial pin 76 with longitudinal slot 86 in sleeve 80. The forward end portion of shaft 74 is axially moveable along concave surface 96 of the operator base member 28 and its extreme forward end is pivotally connected to the pivot pin 81 which is eccentrically mounted on the cam member through openings 72,72. At its extreme rear end, the shaft 74 is formed with a key portion 88 engaged with a central key slot 90 in the moveable contact assembly 40.

The mounting plate assembly 32 comprises a plate 104 with a plurality (in this case 8) of tapped holes 106, some of which are engaged by machine bolts 108 to support the switch on a wall 110 of a suitable explosion proof enclosure. Alternatively, plate 104 may be mounted to the wall 110 by welding as shown at 112. A central hub portion 114 extends forwardly through an opening in the wall 110 and may be welded to it, as shown at 116. A sleeve bearing liner 118 journals the shaft 74 for both rotary and axial motion.

An important feature of the invention is that the hub 114 is the only access from the interior of the explosion proof enclosure to the potentially explosive ambient atmosphere; it may be made with sufficient axial length to provide a long enough path for exploding gases to be effectively quenched to a safe temperature when they exit through the hub.

The stationary contact assembly 35 comprises a stationary insulator base 34 and insulator sub-assembly 36, both made of electrical insulating material. Making them in two parts facilitates assembly of the stationary contacts as will now be described.

The insulator base 34 is annular in shape having a central bore 120 and a flange 122 with a plurality (in this case 8) of bolt holes 124. Bolts 126 extend through four of these bolt holes into corresponding tapped openings 106 to hold the stationary contact assembly 35 firmly mounted on the back side of the mounting plate. The forward face 127 within flange 122, is set back to provide a recess 128 within which the flange 82 is rotatable through a range of 90° as permitted by engagement with a stop pin 130 mounted in the forward face 127. The axial clearance of recess 128 is sufficient to enable free rotation of the flange 82 while effectively restricting axial movement of it.

The insulator sub-assembly 36 comprises another annular member supporting four socket type contacts 132, 134, 136 and 138 each having a radially extending terminal portion 140. Sub-assembly 36 is fastened to sub-assembly 34 by a plurality of Allen head cap screws 142, one of which is shown in FIG. 5. It has a central bore 121 comprising a continuation of bore 120 is base 34.

One or more snap acting control switches 144 (FIG. 5) are provided for electrical interlocking between the reversing switch 24 and the main contactor 22. Other of such switches may provide suitable monitoring functions as required for a particular installation. This will be described below.

Figure 8:
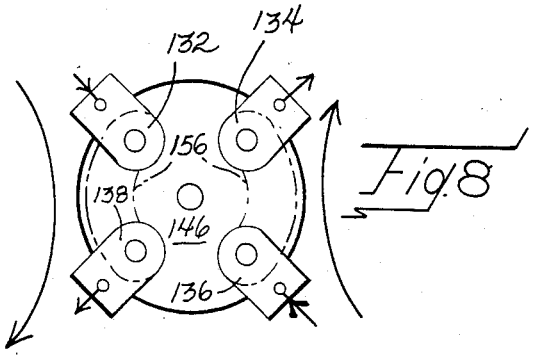
FIG. 8 is a view of the switch contacts in the forward mode corresponding to the handle setting of FIG. 7.
Figure 10:
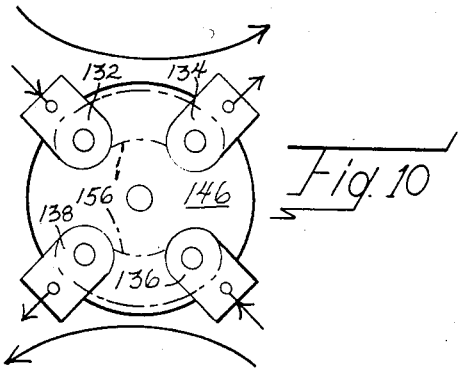
FIG. 10 is a view similar to FIG. 8, showing the switch contacts in the reverse mode corresponding to the handle setting of FIG. 9.

The movable contact assembly 40 comprises a circular plate 146 of electrical insulating material. The key portion 88 at the rear end of shaft 74 is held assembled in key slot 90 by a central bolt 148 and washer 150. Four pin type contacts 152 extend forwardly from plate 146 and are aligned with the four socket type contacts 186. Adjacent contact pins 152 are interconnected in pairs by bolts 154 to arcuate power bus jumpers 156 as best shown in FIGS. 6, 8 and 10.

An important feature of the invention is the simple, direct-acting mechanism for electrically interlocking the reversing switch and main contactors 22 so the latter are always open when the reversing switch is opened or closed, and for indicating whether the switch is in forward or reverse position where it is important to monitor that information.

The interlocking mechanism is illustrated by snap acting control switch 144 which has an actuator 158 actuatable by an adjustable screw 160 held by a lock nut 162 on plate 146. As shown schematically in FIGS. 1 and 5, control switch 144 may be connected to a relay 164 controlling opening and closing of the main contactors 22. Two of these adjusting screws 160 are provided 90° apart as shown in FIG. 6. Thus, one or the other will be aligned with the control switch in each of the forward and reverse positions of the reversing switch. The adjusting screws 160 are set so switch 144 actuates, either opening or closing as appropriate, while the pin contacts 152 are firmly engaged within the socket contacts 132–138, this occurring slightly before they are completely seated as shown in FIG. 4, and slightly after unseating movement begins. Control switch 144 opens and closes during forward or rearward swinging movement of the handle assembly at about the handle position shown in broken lines in FIG. 4. From that point rearward, there is a continuously increasing mechanical advantage seating the contacts until it maximizes at the fully seated position of FIG. 4. Similarly, when the handle is pulled forwardly from the FIG. 4 position to disengage the contacts, the maximum mechanical advantage to open the contacts occurs at the beginning. This automatic increase of mechanical advantage as more force as needed to seat and unseat the contacts results from the unique cooperation of the twin cam surfaces 70,70 and the eccentric location of pin 81 as described.

A plurality of openings 166 may be provided around the periphery of stationary component 36, as shown in FIGS. 3 and 5, for various control and monitoring functions other than the interlocking function described, one of these being actuation of remote indicator lamps at a control station to display the forward or reverse mode of the switch.

The compression spring 38 encloses the shaft 74 and sleeve 80 and is compressibly interposed between flange 82 at the forward end and back up washer 168 seated on the movable plate 146 at the rear. Thus, spring 38 biases the movable contact assembly 146 to open the contacts and serves as a helper when the contacts are disengaged by the handle.

Use and operation of the reversing switch is believed apparent from the foregoing description. Briefly, when the detent or plunger 48 is released from recess 73 in operator base member 28 by pulling radially outwardly on the handle 42, the handle is freed to swing forwardly and backwardly in the direction of arrow 174 in FIGS. 4 and 14 while the spring 38 urges the moveable contact assembly 40 rearwardly to the fully open, disengaged position of FIG. 14. At the "actuating position . . . " shown in FIG. 4, and while the contacts are still fully engaged, control switch 144 will actuate relay 164 (FIGS. 1 and 5) to open main power contactors 22.

Figure 7:
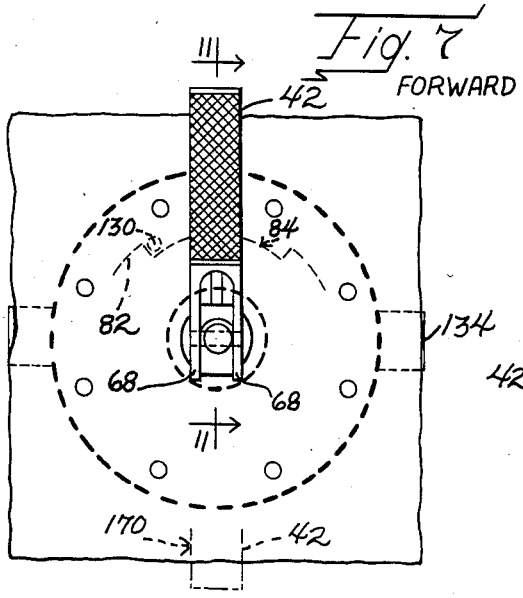
FIG. 7 is a front elevational view of FIG. 4.
Figure 9:
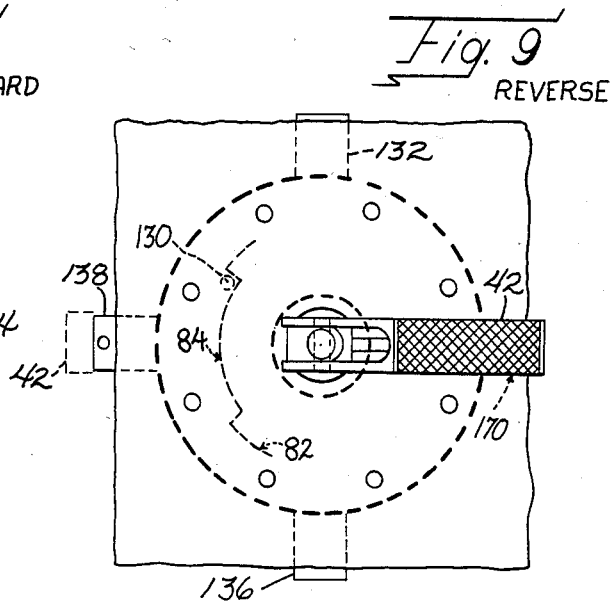
FIG. 9 is a view similar to FIG. 7 showing the switch in reverse disengaged mode.

In the following discussion, FIGS. 4, 7 and 8 are considered the "forward" position comparable to FIG. 1, and FIGS. 9 and 10 are considered the "reverse" position comparable to FIG. 2.

It should be understood that in each of these two rotated positions, the contacts may either be engaged or disengaged.

Thus, when the switch is viewed from the front, as in FIG. 7, it has four significant opeating modes corresponding to handle positions as follows:

(1) "forward engaged" mode with the handle up;

(2) "forward disengaged" mode with the handle down;

(3) "reverse engaged" mode with the handle to the left; and (4) "reverse disengaged" mode with the handle to the right.

Starting in the forward "disengaged" mode with the handle down as shwon in FIG. 14, movement of the handle 42 upwardly along arrow 172 from the solid line position of FIG. 14 to the solid line position of FIG. 4 pulls the shaft 74 forwardly and fully seats the contact pins 152 in the contact sockets 132, 134, 136, and 138. The handle remains locked in that position by engagement of plunger 48 in recess 73. This is the "forward engaged" mode referred to above in which the bus jumpers 156 interconnect socket contacts 132 and 138 and interconnect socket contacts 134 snf 136 as shown in FIG. 8. During this upward movement of the handle and after it passes through the switch "ACTUATING POSITION" shown in FIG. 4, switch 144 actuates relay 164 to close main contactors 22.

The reversing switch is moved from the above described "forward engaged" mode (handle up) to the "reverse engaged" mode (handle to the left) as follows: the plunger 48 is first released from recess 73 and then the handle is moved forwardly, rearwardly and downwardly along arrow 174 from the solid line position in FIG. 4 to the solid line position in FIG. 14. During this movement, the handle again passes through the "ACTUATING POSITION" shown in FIG. 4 and shortly before that position switch 144 again actuates relay 164, this time to open the main power contacts 22. This returns the reversing switch to the "forward disengaged" mode with the handle down as shown in FIG. 14. The handle is then rotated a quarter turn counterclockwise, in the direction of arrow 170 in FIGS. 7 and 9 to the opposite rotational limit permitted by stop pin 130 and quadrantal cut-out 84. This is the "reverse disengaged" mode where the handle is shown in solid lines to the right in FIG. 9. This realigns the moveable contact pins 152 with different combinations of the four stationary contact sockets 132, 134, 136, and 138. The handle is then pulled forwardly and pushed rearwardly to the left to the broken line position in FIG. 9 to fully seat the contact pins 152 in the contact sockets 132–138, and handle is locked by releasing it to seat plunger 48 in recess 73. During this movement, control switch 144 once again actuates relay 164 to reclose main power contactors 22 after the handle passes the actuating position shown in FIG. 4. As shown in FIG. 10, stationary contact sockets 132 and 134 are interconnected, and stationary contact sockets 136 and 138 are interconnected by the respective power bus jumpers 156. This is the "reverse engaged" mode.

While the specific form of reversing switch described an shown herein constitutes a preferred embodiment of the invention, it is understood that the invention is not limited to this precise form and changes may be made therein without departing from the scope of the invention. For example, in the arrangement shown, there are four mating pin and socket contacts which is the minimum requirement for a three phase reversing switch. By extending the shaft 74 and making some minor changes in construction (not shown) it is possible and practicable to extend the arrangement shown and add additional stationary contact assemblies 35 and additional moveable contact assemblies 40 to build up a double or triple circuit reversing switch.

The embodiments of the invention in which an exclusive property or privilege is claimed are defined as follows:

1. A reversing switch comprising:

an enclosure;

a hub extending through a wall of said enclosure;

a shaft rotatably and axially journaled in said hub;

stationary first contact means within said enclosure including a stationary first electrical insulating member having a first set of four power conducting contacts evenly circumferentially spaced thereon;

movable second contact means including a movable second electrical insulating member having a second set of four power conducting contacts evenly circumferentially spaced thereon, and power bus jumpers interconnecting opposite pairs of said second of power conducting contacts;

said shaft connected to said movable second contact means;

external handle means connected to said shaft and being rotatable through a quarter turn range to align different combinations of said first and second sets of contacts at opposite ends of said range, said handle means also being swingable forwardly and backwardly through a half turn range;

cam means connected between said handle means and shaft for moving said first and second sets of contacts from open to fully seated positions in response to outward movement of the shaft by a half turn forward and backward swinging movement of said handle means in one direction;

spring means biasing said shaft and second electrical insulating member in a direction to disengage said first and second sets of contacts; and said cam means being effective in response to a half turn forward and backward swinging movement of said handle means in a direction opposite said one direction to enable said spring means to move said shaft and second insulating member in a direction to disengage said first and second sets of contacts.

2. A reversing switch according to claim 1 having an external operator member interposed between the cam means and the hub and being rotatable with said handle means, said operator member having a transverse plungerreceiving recess therein, said handle means having a locking plunger aligned with said recess when the handle means is swung to one end of said half turn range corresponding to a fully seated condition of said contacts, and means for manually moving said handle to selectively engage or disengage said locking plunger in or from said recess.

3. A reversing switch according to claim 1 having control switch means supported on said stationary first electrical insulating member and an adjustable actuator means for the control switch means supported on said movable second electrical insulating member and effective to actuate the switch means at a predetermined proximity between said movable and stationary members to thereby actuate a remote set of power contactors to deenergize the power supply while said first and second sets of contacts are being engaged or disengaged.

4. A reversing switch comprising:

a mounting plate assembly attachable to a wall of an explosion-proof enclosure and having a forwardly-extending hub adapted to extend through said wall and having a front thrust bearing surface on the forward end thereof;

a shaft rotatably and axially journaled in said hub and extending forwardly and rearwardly therefrom;

an external operator member having a base portion with an opening through which the shaft extends and within which the shaft is journaled for forward and backward reciprocable movement, said base portion having a rear thrust bearing surface engaging said front thrust bearing surface on the hub, said base portion having a pair of front, parallel, cam tracks in a plane transverse to the axis of the shaft on opposite sides of said shaft, and a forwardly projecting portion extending along the shaft from the base portion between said tracks having a pair of spaced, parallel flat cam guide surfaces extending along opposite sides of the shaft and having a plunger-receiving recess;

an operator assembly including elongated handle means and a bifurcated cam member at one end thereof having a pair of parallel, plate-like cam elements with identical, arcuate cam lobes on the forward edges thereof, said cam elements being transversely spaced to provide an overlapping sliding fit with said pair of spaced, parallel flat cam guide surfaces on the base portion of said external operator, said cam lobes concurrently engaging said cam tracks, a pivotal connection between the shaft and said cam elements being eccentrically offset from the axis of the handle means, said handle means having a plunger engageable with said recess in the external operator to lock the handle means and shaft in a selected operated position;

insulator base means comprising a member made of electrical insulating material and fastened to the back side of said mounting plate assembly and having a central aperture through and beyond which said shaft extends, said insulator base means having a stationary contact assembly consisting of a first set of four power conducting contacts evenly circumferentially spaced thereon, and separate control switch means;

a movable contact assembly comprising a member made of electrical insulating material fastened to the rear end of the shaft behind said insulator base means and having a second set of four power conducting contacts evenly circumferentially spaced thereon and engageable with said first set of contacts, and adjustment screw means engageable with said control switch means to actuate the latter when said first and second sets of contacts are seated and unseated to a predetermined extent, and power bus jumpers interconnecting opposite pairs of said second set of power conducting contacts;

spring means extending through said central aperture in the insulator base means, encircling said shaft, and acting between said mounting plate assembly and said moveable contact assembly to bias said first and second sets of contacts toward an open condition; and mechanical means acting between said insulator base means and the shaft enabling axial movement of the shaft while limiting rotation of said shaft to substantially a quarter turn thereby enabling opposite pairs of said second contacts to engage different selected pairs of said first contacts at opposite ends of said quarter turn of the shaft.

5. A reversing switch according to claim 4 in which said mechanical means comprises a sleeve slidably mounted on the shaft, a pin and slot connection between the sleeve and shaft enabling relative axial movement but preventing relative rotational movement between the two, said sleeve having flange means between said mounting plate assembly and said insulator base means, said flange means having a substantially quadrantal cut-out, and a stationary pin in said cut-out, limiting rotation of said sleeve and shaft to a quarter turn.

6. A reversing switch according to claim 5 in which said stationary pin is carried by at least one component including said mounting plate assembly and said insulator base means.

* * * * *